US007938094B2

(12) United States Patent
Toda

(10) Patent No.: US 7,938,094 B2
(45) Date of Patent: May 10, 2011

(54) INTERNAL COMBUSTION ENGINE

(75) Inventor: Tadashi Toda, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 234 days.

(21) Appl. No.: 11/993,587

(22) PCT Filed: May 15, 2007

(86) PCT No.: PCT/JP2007/059962

§ 371 (c)(1),
(2), (4) Date: Dec. 21, 2007

(87) PCT Pub. No.: WO2007/132847

PCT Pub. Date: Nov. 22, 2007

(65) Prior Publication Data

US 2010/0147255 A1 Jun. 17, 2010

(30) Foreign Application Priority Data

May 16, 2006 (JP) ..... 2006-136755

(51) Int. Cl.
*F02B 75/22* (2006.01)

(52) U.S. Cl. ..... 123/195 R; 123/196 R

(58) Field of Classification Search ..... 123/195 R, 123/196 R

See application file for complete search history.

(56) References Cited

U.S. PATENT DOCUMENTS

| | | | |
|---|---|---|---|
| 4,532,897 | A | 8/1985 | Mezger |
| 6,820,585 | B2 | 11/2004 | Maeda et al. |

FOREIGN PATENT DOCUMENTS

| | | | |
|---|---|---|---|
| JP | 62-190820 | U | 12/1987 |
| JP | 64-27739 | A | 1/1989 |
| JP | 3-95006 | U | 9/1991 |
| JP | 5-27212 | U | 4/1993 |
| JP | 5-27328 | U | 4/1993 |
| JP | 8-135423 | A | 5/1996 |

*Primary Examiner* — Noah Kamen

(74) *Attorney, Agent, or Firm* — Sughrue Mion, PLLC

(57) ABSTRACT

An internal combustion engine including an oil passage, which connects the interior of a crankcase and the interior of a cylinder head, is disclosed. The oil passage is open at the upper section of the crankcase. Oil in the cylinder head is transferred to the crankcase via the oil passage and trickles down along an inner wall surface of a skirt of the crankcase to be returned to an oil pan. The crankcase accommodates an operating member such as a connecting rod. A protrusion formed on the inner wall surface of the skirt extends substantially along a projected part, which is a projection of the operating member projected on the inner wall surface in a direction perpendicular to the axis of the crankshaft, such that the protrusion separates at least part of the projected part from a section of the inner wall surface closer to the opening of the oil passage.

7 Claims, 4 Drawing Sheets

INTERNAL COMBUSTION ENGINE

FIELD OF THE INVENTION

The present invention relates to an internal combustion engine in which oil in an oil pan is supplied to parts requiring lubrication.

BACKGROUND OF THE INVENTION

An internal combustion engine includes an oil pan that stores oil. The oil is supplied to and lubricates parts requiring lubrication in the engine. After being used for lubrication, the oil is returned to the oil pan.

Patent Document 1 discloses an internal combustion engine, in which some of the oil used for lubricating parts requiring lubrication trickles down along an inner wall surface of the cylinder block and is returned to the oil pan. Such an internal combustion engine has an oil passage that connects the interior of the crankcase and the interior of the cylinder head. The oil that has been used for lubricating parts requiring lubrication in the cylinder head is returned to the crankcase through the oil passage, and some of the oil trickles down along the inner wall surface of the cylinder block and is returned to the oil pan.

An internal combustion engine, in which the oil passage is open at the upper section of the crankcase, has also been proposed. In such an internal combustion engine, some of the oil returned to the crankcase trickles down along the inner wall surface of a skirt of the crankcase and is returned to the oil pan.

In the internal combustion engine configured as described above, the crankshaft rotates at high speed in the crankcase of the cylinder block. As the crankshaft rotates at high-speed, the connecting rods operates at high speed.

Thus, when the direction of movement of operating members such as the crankshaft and the connecting rod intersects the flowing direction of the oil that trickles down along the inner wall surface of the skirt, air flow generated in accordance with the operation of the operating members or the operating members themselves interfere with the oil that trickles down as described above.

This undesirably stirs the oil thereby generating air bubbles in the oil, and increases the rotational resistance of the operating members, which increases the fuel consumption.

Patent Document 1: Japanese Laid-Open Patent Publication No. 8-135423

SUMMARY OF THE INVENTION

Accordingly, it is an objective of the present invention to provide an internal combustion engine that suppresses interference between oil that trickles down along an inner wall surface of a skirt and operating members.

To achieve the above objective, and in accordance with one aspect of the present invention, an internal combustion engine including an oil passage, which connects the interior of a crankcase and the interior of a cylinder head, is provided. The oil passage is open at an upper section of the crankcase. Oil in the cylinder head is transferred to the crankcase via the oil passage and trickles down along an inner wall surface of a skirt of the crankcase to be returned to an oil pan. The crankcase accommodates a crankshaft and an operating member. A step is formed on the inner wall surface. The step extends substantially along a projected part, which is a projection of the operating member projected on the inner wall surface in a direction perpendicular to the axis of the crankshaft, such that the step separates at least part of the projected part from a section of the inner wall surface closer to the opening of the oil passage. The step is formed such that the inner wall surface closer to the opening with respect to the step is dented by a greater degree than a part of the step closer to the projected part.

DETAILED DESCRIPTION OF THE PREFERRED EMBODIMENTS

An internal combustion engine according to a first embodiment of the present invention will now be described.

A schematic structure of the internal combustion engine according to the first embodiment will now be described with reference to FIG. 1.

Figure 1:
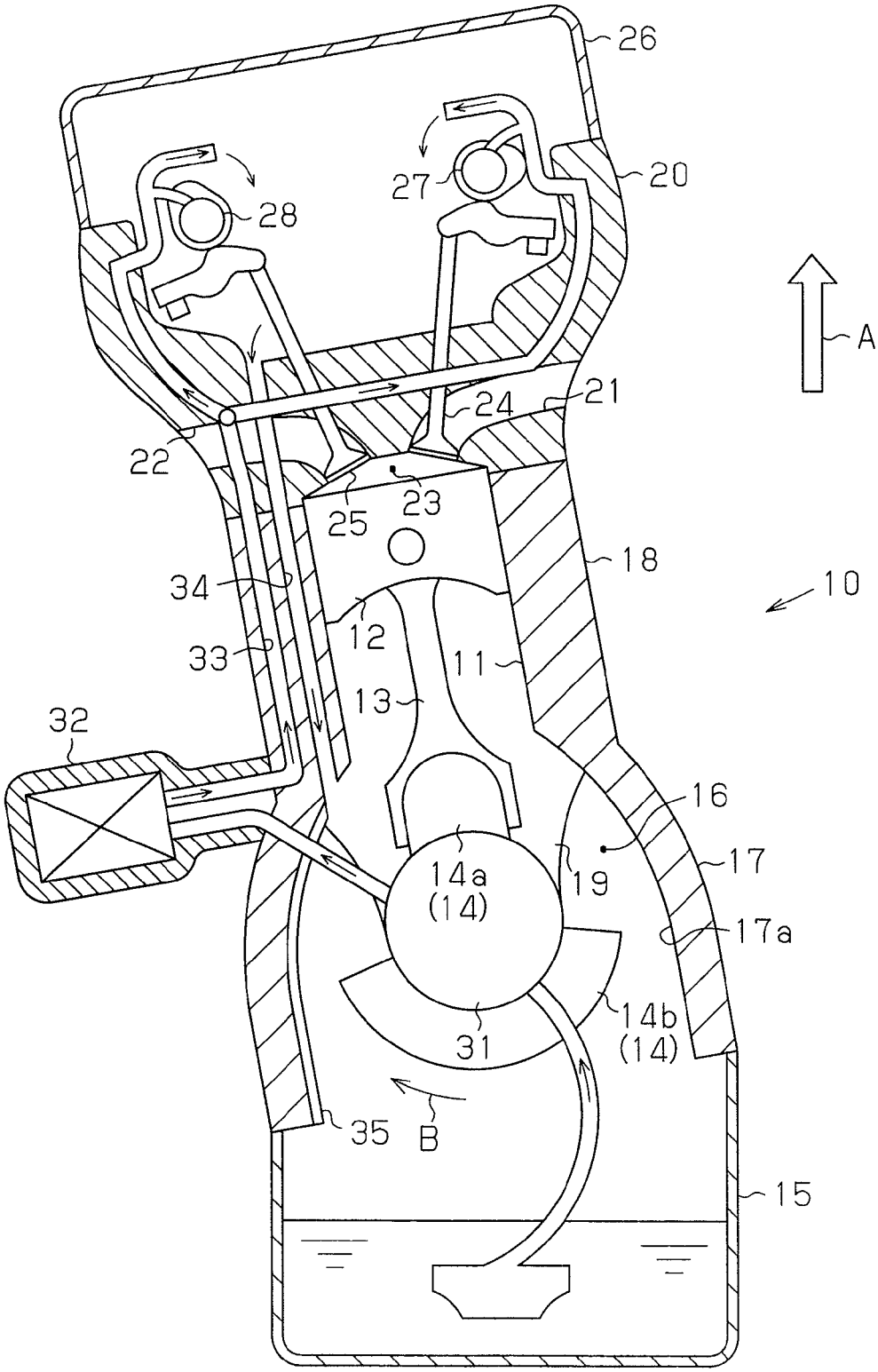
FIG. 1 is a schematic view illustrating an internal combustion engine according to a first embodiment of the present invention.

As shown in FIG. 1, a cylinder block 10 of the internal combustion engine according to the first embodiment includes cylinder bores 11 (only one is shown). Each cylinder bore 11 accommodates a piston 12. Each piston 12 is connected to a crankshaft 14 via an operating member, which is a connecting rod 13 in the first embodiment. The connecting rod 13 converts reciprocation of the piston 12 to rotation of the crankshaft 14. An oil pan 15 is attached to the bottom of the cylinder block 10. The oil pan 15 stores oil supplied to parts requiring lubrication in the engine.

A cylinder head 20 of the internal combustion engine includes intake ports 21 and exhaust ports 22. One of the intake ports 21 and one of the exhaust ports 22 correspond to each cylinder bore 11. Each pair of the intake port 21 and the exhaust port 22 are connected to a combustion chamber 23. Each intake port 21 is provided with an intake valve 24 and each exhaust port 22 is provided with an exhaust valve 25. The cylinder head 20 is covered with a head cover 26 from above.

An intake camshaft 27 and an exhaust camshaft 28 are provided in the cylinder head 20. The intake camshaft 27 selectively opens and closes the intake valves 24 and the exhaust camshaft 28 selectively opens and closes the exhaust valves 25. The intake camshaft 27 and the exhaust camshaft 28 are coupled to and driven by the crankshaft 14 by means of a timing belt (not shown). The rotation of the intake camshaft 27 selectively opens and closes each intake valve 24, thereby selectively connecting and disconnecting the associated intake port 21 to and from the corresponding combustion chamber 23. The rotation of the exhaust camshaft 28 selectively opens and closes each exhaust valve 25, thereby selectively connecting and disconnecting the associated exhaust port 22 to and from the corresponding combustion chamber 23.

The lubrication system of the internal combustion engine will now be explained.

The internal combustion engine includes an oil pump 31, which pumps the oil in the oil pan 15. The oil pumped up by the oil pump 31 is filtered through a filter 32 to remove foreign objects and is then pressurized and sent to the parts requiring lubrication in the engine through a pressure oil duct 33. The parts requiring lubrication include parts arranged in the cylinder block 10 (more specifically, sliding parts around the pistons 12, the connecting rods 13, and the crankshaft 14) and parts arranged in the cylinder head 20 (more specifically, sliding parts around the intake valves 24, the exhaust valves 25, the intake camshaft 27, and the exhaust camshaft 28).

The oil that has been used for lubricating parts requiring lubrication trickles down in the cylinder block 10 and is stored in the oil pan 15 again. The internal combustion engine according to the first embodiment includes an oil passage 34, which connects the interior of the cylinder block 10 (more specifically, a crankcase 16) and the interior of the cylinder head 20. The oil that has been used for lubricating parts requiring lubrication in the cylinder head 20 flows through the oil passage 34 into the crankcase 16, and is returned to the oil pan 15. Some of the oil returned to the crankcase 16 via the oil passage 34 trickles down along an inner wall surface 17*a* of the crankcase 16 (more specifically, a skirt 17), and is returned to the oil pan 15.

The oil passage 34 will now be described in detail.

The internal combustion engine according to the first embodiment is mounted on a vehicle. Arrow A in FIG. 1 represents the vertical direction when the vehicle is stopped on a horizontal road surface. The engine is mounted on the vehicle in a slightly inclined state such that the intake ports 21 are located at higher positions than the exhaust ports 22. The oil passage 34 is open at a low position in the cylinder head 20 (position close to the exhaust ports 22) so that the oil in the cylinder head 20 efficiently flows into the oil passage 34.

The oil passage 34 is open at a position closer to one of a pair of skirts 17 (more specifically, the skirt 17 closer to the exhaust ports 22) in the cylinder block 10. The oil passage 34 is open in the lower surface of part of the cylinder block 10 where the cylinder bores 11 are formed (that is, below a cylinder section 18). A bearing 19 for the crankshaft 14 is located below the cylinder section 18, and the bearing 19 extends toward the interior of the crankcase 16. The oil passage 34 is open beside the bearing 19.

Figure 2:
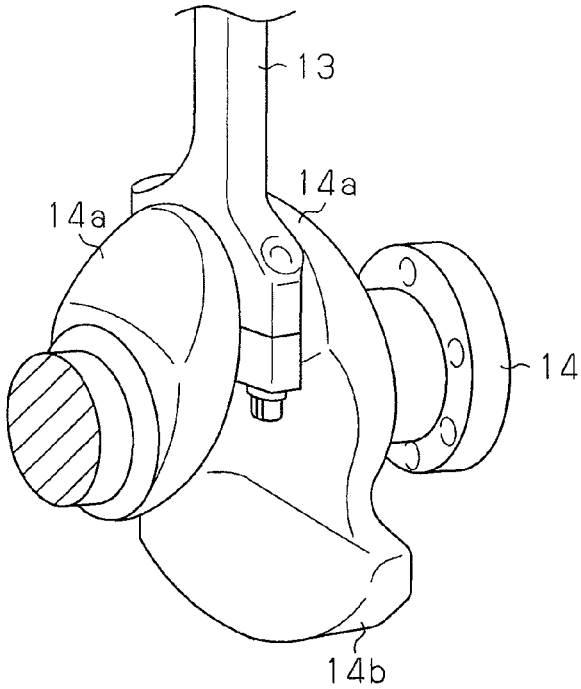
FIG. 2 is a perspective view illustrating the crankshaft of FIG. 1.

FIG. 2 is a perspective view of the crankshaft 14. The crankshaft 14 includes pairs of crank arms 14*a*, and each pair of the crank arms 14*a* corresponds to one of the cylinder bores 11 as shown in FIG. 2. One of the crank arms 14*a* is provided with a counterweight 14*b*.

Figure 3:
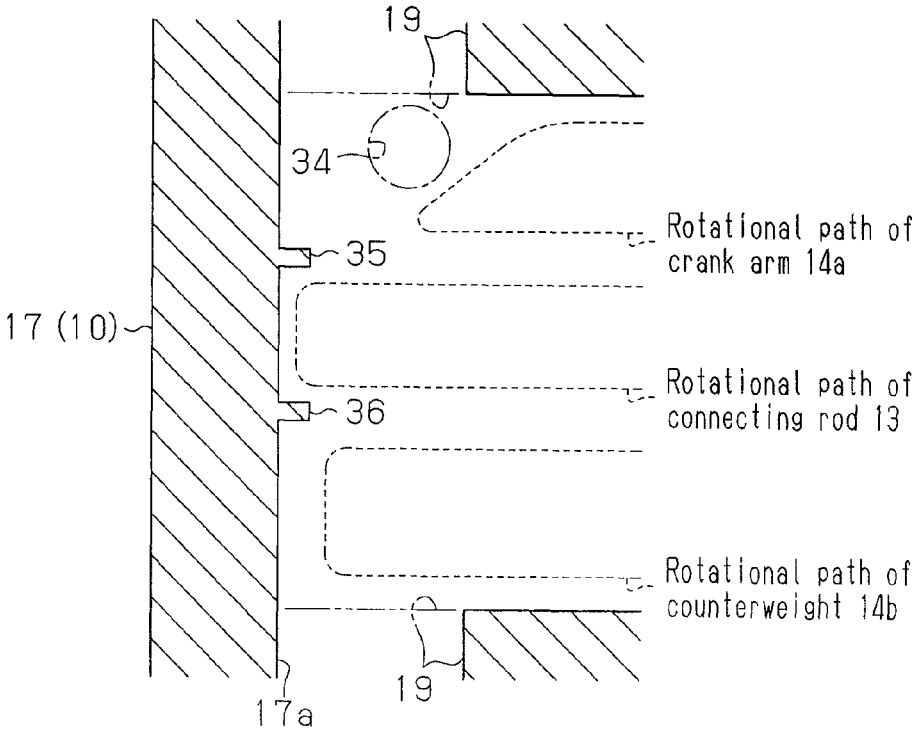
FIG. 3 is an enlarged partial cross-sectional view illustrating the crankcase of FIG. 1.

FIG. 3 is a cross-sectional plan view of part of the crankcase 16.

As shown in FIG. 3, the opening of the oil passage 34 (shown by a dashed line) is at a position that does not overlap with the rotational paths (shown by broken lines) of the connecting rod 13, the crank arm 14*a*, and the counterweight 14*b* as viewed from the vertical direction. This prevents the oil that enters the crankcase 16 through the opening of the oil passage 34 from dropping on the connecting rod 13 and the crankshaft 14.

In the internal combustion engine according to the first embodiment, the flowing direction of the oil intersects the direction of movement of the crankshaft 14 and the connecting rod 13 (the direction shown by arrow B in FIG. 1) at part of the inner wall surface 17*a* of the skirt 17 along which the oil trickles down. With this configuration, the crankshaft 14 or the connecting rod 13 tends to easily interfere with the oil that trickles down along the inner wall surface 17*a* of the skirt 17, thereby generating air bubbles in the oil and increasing the fuel consumption.

However, according to the internal combustion engine of the first embodiment, the gap between the crankshaft 14 (more specifically, the crank arm 14*a* and the counterweight 14*b*) and the inner wall surface 17*a* of the skirt 17 is relatively large (see FIG. 3). Thus, the oil that trickles down along the inner wall surface 17*a* hardly interferes with the crankshaft 14. In contrast, the gap between the inner wall surface 17*a* of the skirt 17 and the connecting rod 13 is very small. Thus, the oil that trickles down along the inner wall surface 17*a* of the skirt 17 might interfere with the connecting rod 13.

With this point in view, in the first embodiment, a protrusion 35, which serves as a step, is formed on the inner wall surface of the skirt 17 in the vicinity of the opening of the oil passage 34 to suppress the interference between the oil that trickles down along the inner wall surface 17*a* of the skirt 17 and the connecting rod 13.

Figure 4:
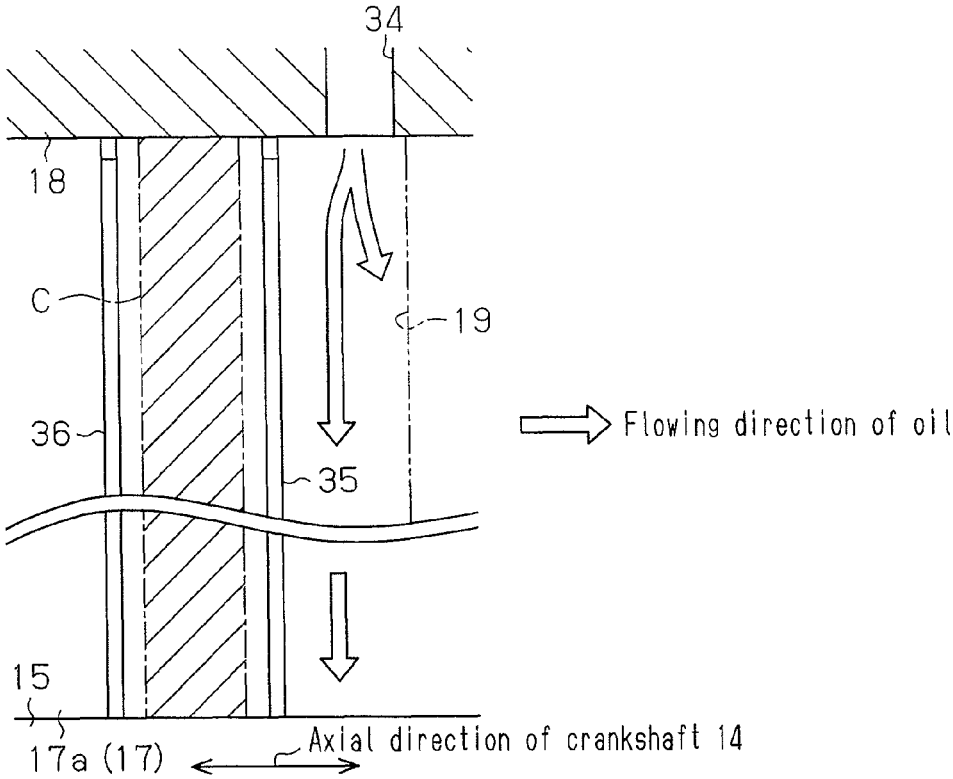
FIG. 4 is a cross-sectional view illustrating the inner wall surface of the skirt of FIG. 1 as viewed from the crankshaft.

FIG. 4 shows the structure of the inner wall surface 17*a* of the skirt 17 on which the protrusion 35 is provided as viewed from the crankshaft 14.

In FIG. 4, a shaded part C corresponds to a projection of the connecting rod 13, which operates in the crankcase 16, projected on the inner wall surface 17*a* of the skirt 17 in a direction perpendicular to the axial direction of the crankshaft 14.

As shown in FIG. 4, the protrusion 35 is provided on one side of the projected part C that is closer to the opening of the oil passage 34. The protrusion 35 extends along the longitudinal direction of the projected part C from the end of the skirt 17 closer to the cylinder section 18 to the end of the skirt 17 closer to the oil pan 15. The protrusion 35 partitions the skirt 17 in which the opening of the oil passage 34 is formed into a region including the entire projected part C and a region closer to the opening of the oil passage 34. The protrusion 35 forms a step on the inner wall surface 17*a* of the skirt 17. The step is formed such that the inner wall surface 17*a* closer to the opening with respect to the step is dented by a greater degree than a part of the step closer to the projected part C.

A protrusion 36 is formed on the side of the projected part C further from the opening of the oil passage 34. The protrusion 36 extends along the longitudinal direction of the projected part C from the end of the skirt 17 closer to the cylinder section 18 to the end of the skirt 17 closer to the oil pan 15.

According to the first embodiment, the protrusion 35 controls the flow of the oil that is fed into the crankcase 16 through the oil passage 34 and trickles down along the inner wall surface 17*a* of the skirt 17. Thus, the protrusion 35 suppresses the oil from flowing to the projected part C, in other wards, to the part where the gap between the inner wall surface 17*a* of the skirt 17 and the connecting rod 13 is small. As a result, the interference between the oil that trickles down along the inner wall surface 17*a* of the skirt 17 and the connecting rod 13 is suppressed.

Furthermore, the protrusion 35 prevents the oil that trickles down along the inner wall surface 17*a* of the skirt 17 from spreading to a wide area of the inner wall surface 17*a*, which permits the oil to be promptly returned to the oil pan 15. Therefore, when the internal combustion engine is operated in a cold state, the oil that has been used for lubricating parts requiring lubrication and that has a relatively high temperature is promptly returned to the oil pan 15. As a result, the oil temperature is promptly increased, which permits the engine to be warmed up at an early stage, thus reducing the fuel consumption.

Furthermore, since the protrusions 35, 36 are formed on the inner wall surface 17*a* of the skirt 17, the protrusions 35, 36 function as reinforcing ribs. This improves the rigidity of the skirt 17, and thus the rigidity of the cylinder block 10, which suppresses generation of vibration and noise.

Reinforcing ribs are generally formed on the outer wall of the cylinder block. However, the internal combustion engine according to the first embodiment eliminates the necessity of such ribs.

The protrusions 35, 36 formed on the skirt 17 extend from the end closer to the cylinder section 18 to the end closer to the oil pan 15. Therefore, when molding the cylinder block 10, the mold used for molding the cylinder block 10 is simplified compared to a case where a protrusion extends parallel to the lower surface of the cylinder section 18 on the inner wall surface 17*a* of the skirt 17. The protrusions 35, 36 extend in the same direction as the flow of molten metal when molding the cylinder block 10. This improves the productivity and the quality of the cylinder block 10.

The first embodiment provides the following advantages.

(1) The interference between the oil that trickles down along the inner wall surface 17*a* of the skirt 17 from the oil passage 34 and the connecting rod 13 is suppressed.

(2) The protrusion 35 partitions the skirt 17 in which the opening of the oil passage 34 is formed into a region including the entire projected part C and a region closer to the opening of the oil passage 34. Thus, the oil that trickles down along the inner wall surface 17*a* of one of the pair of skirts 17 from the oil passage 34 is prevented from flowing to the projected part C in a suitable manner. Therefore, the interference between the oil and the connecting rod 13 is suppressed in a suitable manner.

(3) Since the protrusions 35, 36 are formed on the inner wall surface 17*a* of the skirt 17, the rigidity of the cylinder block 10 is improved.

(4) The oil passage 34 is open beside the bearing 19 for the crankshaft 14. The counterweight 14*b* is becoming smaller in these days. In such an internal combustion engine having a small counterweight 14*b*, there is a high possibility that the oil that trickles down along the inner wall surface 17*a* of the skirt 17 interferes with the connecting rod 13. However, the first embodiment reliably suppresses the interference between the oil and the connecting rod 13.

An internal combustion engine according to a second embodiment of the present invention will now be described. The description focuses on the difference between the first embodiment and the second embodiment.

The internal combustion engine according to the second embodiment differs from that of the first embodiment in the shape of the protrusions formed on the inner wall surface 17*a* of the skirt 17.

The protrusions according to the second embodiment will be described below.

Figure 5:
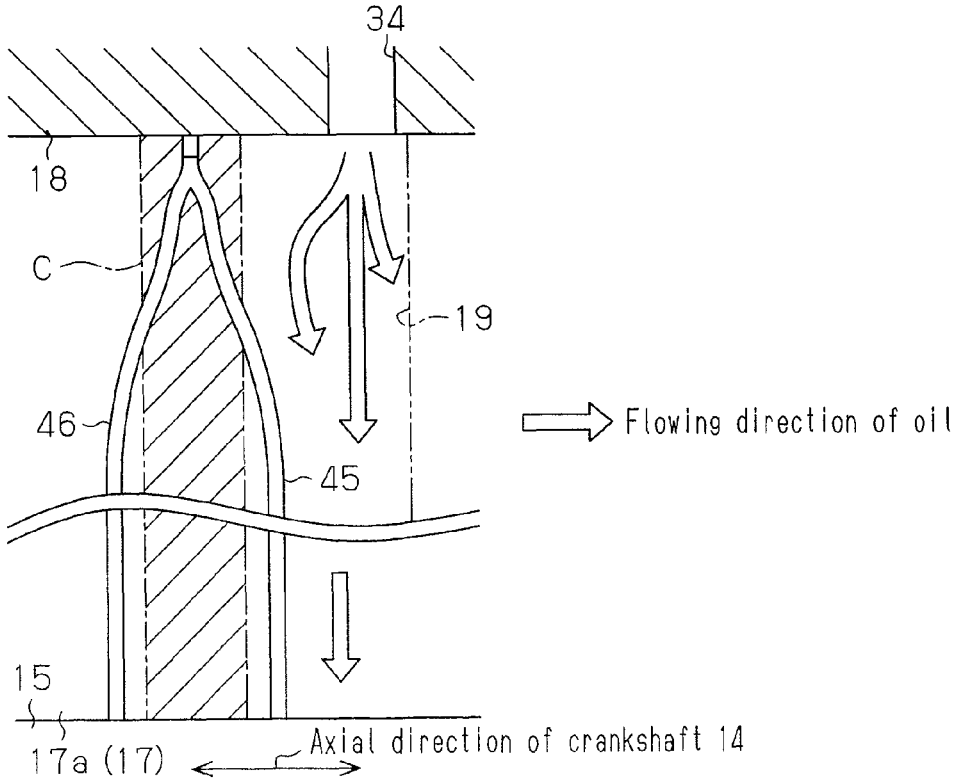
FIG. 5 is a cross-sectional view illustrating an inner wall surface of a skirt according to a second embodiment as viewed from the crankshaft.

FIG. 5 shows the structure of the inner wall surface 17*a* of the skirt 17 of the internal combustion engine according to the second embodiment as viewed from the crankshaft 14.

As shown in FIG. 5, a protrusion 45 is formed on the inner wall surface 17*a* of the skirt 17 in which the opening of the oil passage 34 is formed. The protrusion 45 extends from the end of the skirt 17 closer to the cylinder section 18 (upper side in FIG. 5) to the end closer to the oil pan 15 (lower side in FIG. 5).

Part of the protrusion 45 closer to the cylinder section 18 is located in the projected part C. The protrusion 45 extends such that it gradually approaches and intersects the edge of the projected part C closer to the opening of the oil passage 34 as the distance from the oil pan 15 decreases. The protrusion 45 further extends toward the oil pan 15 along the outside of the projected part C.

The protrusion 45 partitions the skirt 17 in which the opening of the oil passage 34 is formed into a region including the lower section of the projected part C and a region closer to the opening of the oil passage 34.

A protrusion 46 is also formed on the inner wall surface 17*a* of the skirt 17 extending from the end of the skirt 17 closer to the cylinder section 18 (upper side in FIG. 5) to the end closer to the oil pan 15 (lower side in FIG. 5). The protrusion 46 is formed integrally with the protrusion 45 at a portion close to the cylinder section 18 (upper section in FIG. 5). The protrusion 46 extends such that it gradually approaches and intersects the edge of the projected part C further from the opening of the oil passage 34 as the distance from the oil pan 15 (lower side in FIG. 5) deceases. The protrusion 46 further extends toward the oil pan 15 along the outside of the projected part C.

In a typical internal combustion engine, a space for operation of the connecting rod provides a large gap between the connecting rod and the inner wall surface of the skirt at the upper section of the skirt and a small gap at the lower section of the skirt. Therefore, the interference between the connecting rod 13 of the engine and the oil that trickles down along the inner wall surface 17*a* of the skirt 17 tends to occur at the lower section of the skirt 17.

According to the second embodiment, the protrusion 45 controls the flow of the oil that is fed into the crankcase 16 through the oil passage 34 and trickles down along the inner wall surface 17*a* of the skirt 17. Thus, the protrusion 45 suppresses the oil from flowing to the lower section of the projected part C, in other wards, the section where the interference between the oil and the connecting rod 13 easily occurs. As a result, the interference between the oil that trickles down along the inner wall surface 17*a* of the skirt 17 and the connecting rod 13 is suppressed.

Furthermore, the protrusion 45 prevents the oil that trickles down along the inner wall surface 17*a* of the skirt 17 from spreading to a wide area of the inner wall surface 17*a*, which permits the oil to be promptly returned to the oil pan 15. Therefore, when the internal combustion engine is operated in a cold state, the oil that has been used for lubricating parts requiring lubrication and that has a relatively high temperature is promptly returned to the oil pan 15. As a result, the oil temperature is promptly increased, which permits the engine to be warmed up at an early stage, thus reducing the fuel consumption.

Furthermore, since the protrusions 45, 46 are formed on the inner wall surface 17*a* of the skirt 17, the protrusions 45, 46 function as reinforcing ribs. This improves the rigidity of the skirt 17, and thus the rigidity of the cylinder block 10, which suppresses generation of vibration and noise.

The second embodiment provides the following advantages.

(1) The interference between the oil that trickles down along the inner wall surface 17*a* of the skirt 17 from the oil passage 34 and the connecting rod 13 is suppressed.

(2) The protrusion 45 partitions the skirt 17 in which the opening of the oil passage 34 is formed into a region including the lower part of the projected part C and a region closer to the opening of the oil passage 34. Thus, the oil that trickles down along the inner wall surface 17*a* of one of the pair of skirts 17 from the oil passage 34 is suppressed from flowing to the region including the lower section of the projected part C in a suitable manner. Therefore, the interference between the oil and the connecting rod 13 is suppressed in a suitable manner.

(3) Since the protrusions 45, 46 are formed on the inner wall surface 17*a* of the skirt 17, the rigidity of the cylinder block 10 is improved.

The above embodiments may be modified as follows.

The protrusion 36 (according to the first embodiment) or the protrusion 46 (according to the second embodiment) may be omitted.

Instead of the protrusion 35 (according to the first embodiment) or the protrusion 45 (according to the second embodiment), which forms the step, a groove may be formed in the inner wall surface 17*a* of the skirt 17 to form a step.

Figure 6:
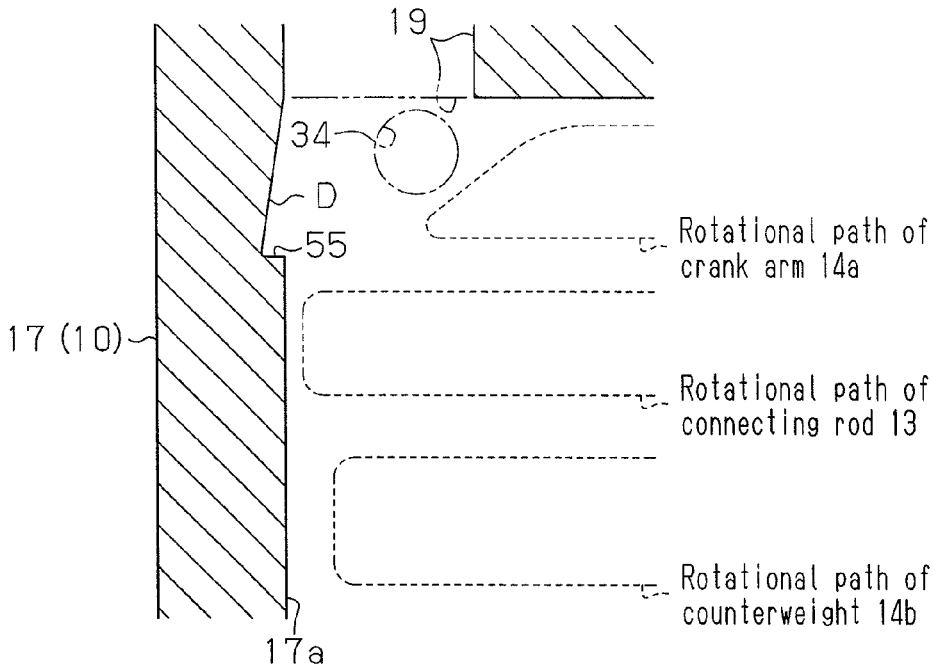
FIG. 6 is an enlarged partial cross-sectional view illustrating a crankcase according to a modified embodiment.
Figure 7:
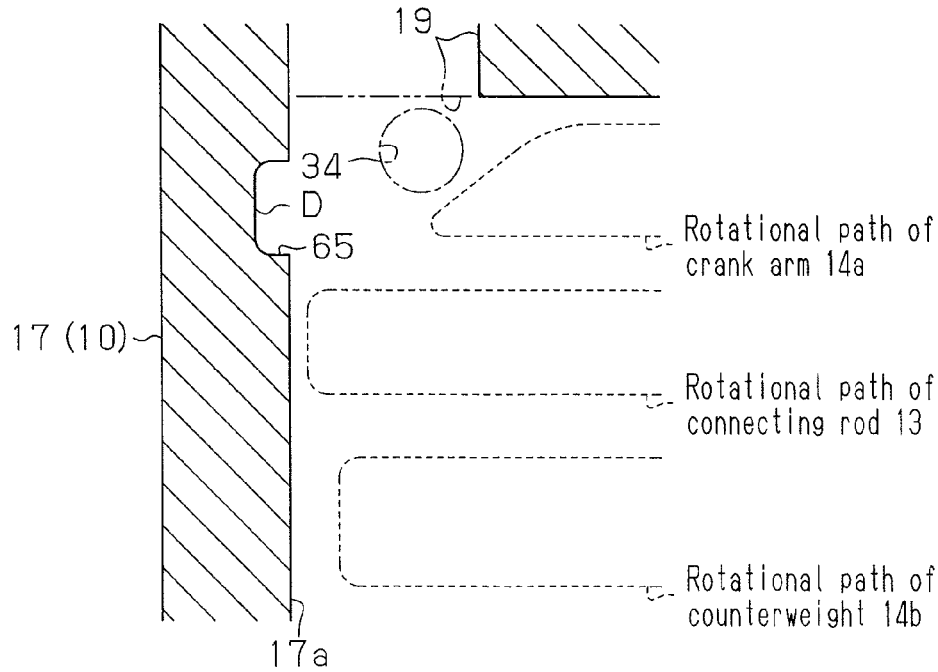
FIG. 7 is an enlarged partial cross-sectional view illustrating a crankcase according to another modified embodiment.

More specifically, as shown in FIGS. 6 and 7, a groove may be formed in the inner wall surface 17*a* of the skirt 17 at a part D closer to the opening of the oil passage 34 than the projected part C. This forms steps 55, 65, which partition the skirt 17 in which the opening of the oil passage 34 is formed into a region including at least part of the projected part C and a region closer to the opening of the oil passage 34. As shown in FIGS. 6 and 7, the shape of the groove may be modified as required.

The above embodiments may be applied to an internal combustion engine in which the oil passage 34 is open in the lower surface or the side surface of the bearing 19.

A step corresponding to the counterweight 14*b*, which serves as the operating member, may be provided. Assume that the counterweight 14*b* is projected on the inner wall surface 17*a* of the skirt 17 in a direction perpendicular to the axis of the counterweight 14*b*. A step may be provided on the inner wall surface 17*a* such that at least part of the projected part is separated from a section of the inner wall surface 17*a* of the skirt 17 closer to the opening of the oil passage 34.

The invention claimed is:

1. An internal combustion engine comprising an oil passage, which connects an interior of a crankcase and an interior of a cylinder head, the oil passage being open at an upper section of the crankcase, oil in the cylinder head is transferred to the crankcase via the oil passage and trickles down along an inner wall surface of a skirt of the crankcase to be returned to an oil pan, the crankcase accommodating a crankshaft and an operating member, wherein a step is formed on the inner wall surface, the step extending substantially along a projected part, which is a projection of the operating member projected on the inner wall surface in a direction perpendicular to the axis of the crankshaft, such that the step separates at least part of the projected part from a section of the inner wall surface closer to the opening of the oil passage, the step being formed such that the inner wall surface closer to the opening is recessed from the step.

2. The internal combustion engine according to claim 1, wherein the step partitions the inner wall surface into a region including the entire projected part and a region closer to the opening.

3. The internal combustion engine according to claim 1, wherein the step partitions the inner wall surface into a region including a lower section of the projected part and a region closer to the opening.

4. The internal combustion engine according to claim 1, wherein the step is formed by providing a protrusion on the inner wall surface.

5. The internal combustion engine according to claim 1, wherein the step is formed by providing a groove in the inner wall surface.

6. The internal combustion engine according to claim 1, wherein a pair of the skirts are provided to face each other, and the opening is located closer to one of the pair of skirts.

7. The internal combustion engine according to claim 1, wherein the operating member is a connecting rod, and wherein the oil passage is open beside a bearing of the crankshaft provided in the crankcase.

* * * * *